United States Patent [19]

MacDonald, Jr. et al.

[11] Patent Number: 4,561,203

[45] Date of Patent: Dec. 31, 1985

[54] OPAQUE SIGN PLAQUE WITH DUAL REFLECTOR ILLUMINATION

[75] Inventors: Robert D. MacDonald, Jr., Carmel, N.Y.; William A. Luca, Cheshire; Robert M. Johnstone, Shelton, both of Conn.

[73] Assignee: Dual-Lite Manufacturing, Naguabo, P.R.

[21] Appl. No.: 520,334

[22] Filed: Aug. 4, 1983

[51] Int. Cl.[4] ..... G09F 13/04

[52] U.S. Cl. ..... 40/570; 40/558; 40/572; 40/563

[58] Field of Search ..... 40/558, 570, 572, 573, 40/546, 571, 574, 575, 563

[56] References Cited

U.S. PATENT DOCUMENTS

| | | | |
|---|---|---|---|
| 802,646 | 10/1905 | Kettles | 40/563 |
| 1,371,073 | 8/1922 | Monheim | 40/451 |
| 1,707,965 | 4/1929 | Scantlebury | 40/546 |
| 1,724,243 | 8/1929 | Willey | 40/570 |
| 1,735,040 | 11/1929 | Frederick | 40/563 |
| 1,882,647 | 10/1932 | Kanolt | 40/575 |
| 1,915,666 | 6/1933 | Harvey et al. | 40/563 |
| 3,402,493 | 9/1968 | Mellyn et al. | 40/563 |
| 3,546,438 | 7/1970 | Buc | 250/566 |
| 3,931,689 | 1/1976 | Shine | 40/570 |
| 3,938,269 | 2/1976 | Catteau | 40/575 |
| 4,136,474 | 1/1979 | Belokin, Jr. | 40/558 |
| 4,249,231 | 2/1981 | Decaux | 362/31 |

*Primary Examiner*—Gene Mancene
*Assistant Examiner*—Cary E. Stone
*Attorney, Agent, or Firm*—Mattern, Ware, Stoltz & Fressola

[57] ABSTRACT

An illuminated sign with an opaque sign plaque employs a light source overlying the sign plaque embraced by a concave downward facing reflector, and a flat lower reflector underlying the sign plaque, providing both direct and reflected illumination over the face of the sign plaque. In its preferred form, the concave reflector is compoundly curved over the ends of the sign plaque and the flat lower reflector is tilted toward the sign plaque.

10 Claims, 5 Drawing Figures

OPAQUE SIGN PLAQUE WITH DUAL REFLECTOR ILLUMINATION

TECHNICAL FIELD

This invention relates to illuminated signs such as "exit", "elevator" and "escalator" signs, mounted on the walls and ceilings of public buildings or their corridors above the viewers' heads for maximum visibility. Such signs are normally illuminated by one or more light bulbs which may be powered by emergency lighting circuits to assure public access to exits in the event of a power failure. These illuminated signs often employ translucent panels illuminated from behind, with colored transparent glass or plastic material emitting a portion of the illumination, and with a large part of the light energy being absorbed and lost behind the translucent panel. Significant savings in energy costs can be achieved if light losses behind translucent panels can be eliminated

BACKGROUND ART

Externally illuminated sign boards such as billboards or tradesmen's store front signs, with flood lights or foot lights supplying direct illumination to the sign face, have been conventional since the introduction of electric lights. Overhead floodlighting illumination of such signs is illustrated in Monheim, U.S. Pat. No. 1,871,073, issued in 1932 and Frederick, U.S. Pat. No. 1,735,040, issued in 1929.

Backlighted translucent signs are equally conventional, as shown in Willey, U.S. Pat. No. 1,724,243, issued in 1929. More recently, edge lighted signs have been proposed, as shown in Buc, U.S. Pat. No. 3,546,438, issued in 1970; Mellyn, U.S. Pat. No. 3,402,493, issued in 1968 and Decaux, U.S. Pat. No. 4,249,231, issued in 1981.

Overlying floodlighting bulbs illuminating flat reflector surfaces are shown in the 1929 Frederick U.S. Pat. No. 1,735, 040 and also in the 1933 Harvey U.S. Pat. No. 1,915,666. Light bulbs arrayed along the top edge of an opaque sign are shown in Kettles U.S. Pat. No. 802,646, issued in 1905, which also shows a similar array of bulbs along both the top and bottom edges and along all four edges of a rectangular sign embraced by outlying curved reflectors of semi-cylindrical shape, with light rays being thrown equally on opposite sides of the sign board. Such semi-cylindrical reflectors approximate a parabolic cylinder in shape, and tend to gather and converge entering parallel light rays by reflecting them toward a focal line, rather than diffusing them over the face of an opaque sign plaque.

A polygonal array of flat mirror surfaces, directing a series of flashing light spots across the face of a sign board is shown in Monheim, U.S. Pat. No. 1,871,073, issued in 1932.

Conventional opaque illuminated sign plaques have suffered from the common fault of uneven illumination, being brightly lit near the bulbs along one edge of the sign plaque and unlit or dimly lit along the opposite edge. Indeed the 1905 Kettles patent suggested illumination along all four edges of a rectangular opaque sign plaque, in an effort to overcome this unequal illumination problem, and the resulting energy costs for illuminating such a sign make it highly uneconomical.

BRIEF SUMMARY OF THE INVENTION

The opaque externally illuminated sign plaques of the present invention achieve high visibility and bright illumination with a minimum of electrical power. Because of the unique arrangement of reflectors employed in these devices, one or more small electric bulbs, positioned near a first edge of an opaque sign plaque, are embraced by a curved, highly reflective surface trapping and directing their illumination downwardly, both toward and past the indicia-bearing face of the opaque sign plaque. Some of this illumination travels directly to the sign plaque, and some is reflected from the curved reflector to the sign plaque.

The rays of illumination passing the sign plaque are also partially trapped by a smooth, flat, slanting reflective surface extending along the opposite edge of the sign plaque, remote from the electric bulbs, assuring reflected illumination delivered to the lower face of the sign plaque at the precise area where direct illumination fades, and thus equalizing the illumination of the entire visible face of the sign plaque. Some untrapped passing light rays are directed out through the open face of the sign's housing enclosure, to illuminate the walls and floors of the surrounding area for the convenience and safety of the public using the building.

In the preferred embodiment of the invention, two small bulbs above a rectangular opaque sign plaque illuminate both sides of the sign plaque with substantial uniformity, making the sign bright and easy to read from considerable distances with a minimum cost for electric power consumed, while also illuminating the surrounding area.

Accordingly, it is a principal object of the present invention to provide illuminated signs employing opaque sign plaques economically lighted by a minimum number of light bulbs whose illumination is directed to the external face of the sign plaque by two cooperating reflector surfaces to distribute the illumination evenly over the face of the sign while minimizing the electrical energy required to power the device.

A further object of the invention is to provide illuminated signs of this character presenting an upstanding opaque sign plaque to the observer with one or more lamps above the sign plaque providing direct and reflected illumination employing a curved reflecting surface above the lamps to direct the illumination downwardly, cooperating with a flat, slanting, reflective surface underlying the lower edge of the sign plaque and serving to re-reflect light rays from the lamps upwardly toward the lower portion of the sign plaque, thus distributing the illumination uniformly over the entire exposed face of the sign plaque.

Another object of the invention is to provide illuminated signs of this character delivering a portion of their illumination to light the surrounding area for the convenience of the public.

Still another object of the invention is to provide such illuminated signs incorporating light diffuser lenses for uniform light distribution over the length and width of the sign plaque presented to public view.

Other objects of the invention will in part be obvious and will in part appear hereinafter.

The invention accordingly comprises the features of construction, combinations of elements and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings.

DETAILED DESCRIPTITON OF THE INVENTION

Figure 1:
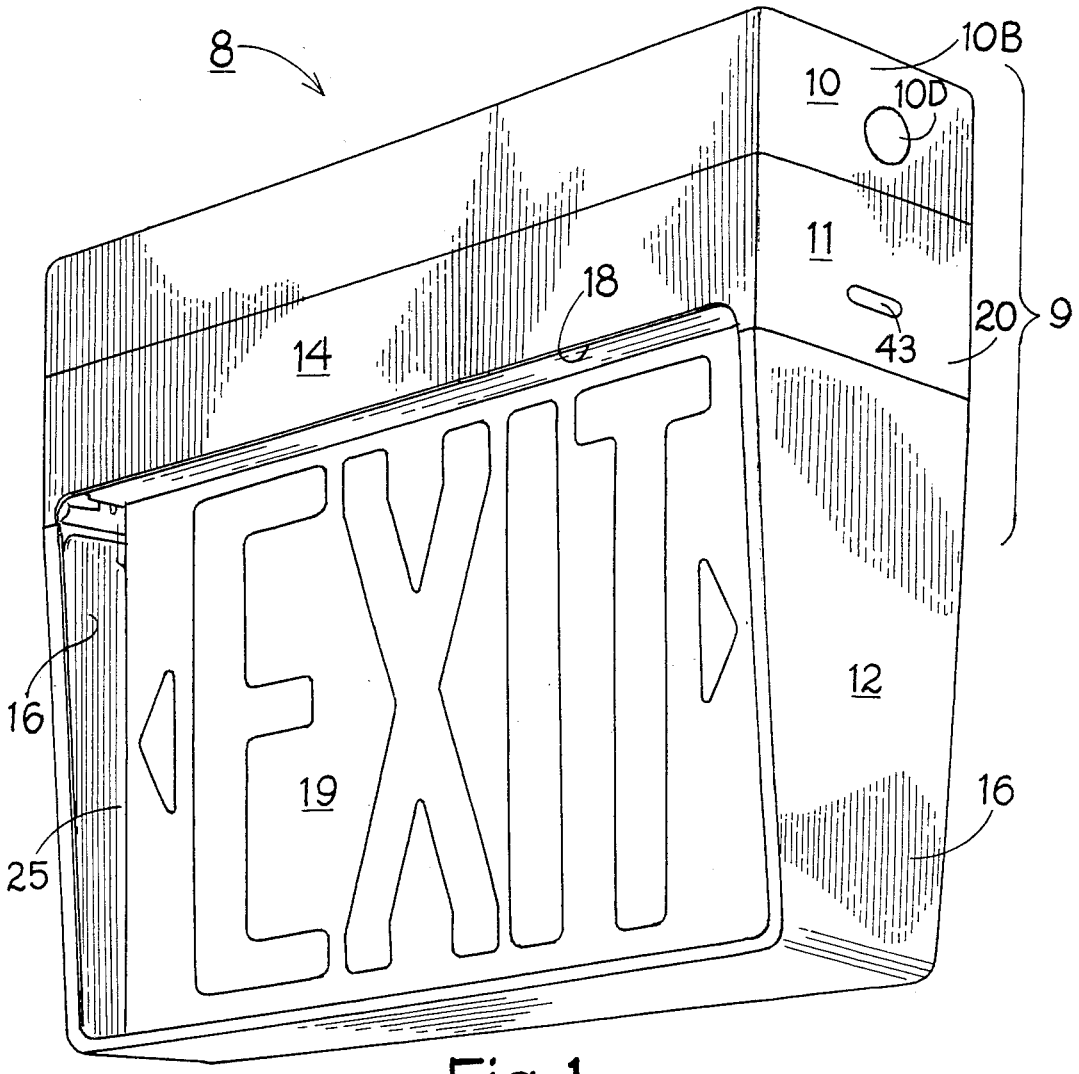
FIG. 1 is a perspective view of an illuminated exit sign comprising a preferred embodiment of the present invention.

A preferred embodiment of the present invention is exemplified by the sign unit 8 shown in FIG. 1, with a three-part housing 9 incorporating an upper wiring enclosure housing 10, a central bulb housing 11, and a depending frame 12.

Wiring housing 10 is provided with top, end and rear mounting faces 10A, 10B and 10C (FIGS. 2 and 3) for securing the fixture to a wall or ceiling, each with a central mounting aperture which may be closed by a snap-in cap 10D if not used for mounting the unit.

Bulb housing 11 is a box-like bulb enclosure 13 with front walls 14 forming the "proscenium arch" of lower edge 18 beneath which the illuminated sign is displayed.

Depending from the ends of bulb housing 11 is a U-shaped frame 12 having upstanding sidewalls 16 with their lower ends joined by a bottom wall 17. The depending sidewalls 16 extend downward from lower edge 18 of the front walls. Bottom wall 17 spans the width of housing 9 and is spaced well below lower edge 18, forming with sidewalls 16 and lower edge 18 a rectangular viewing aperture within which an illuminated sign plaque is displayed.

Figure 2:
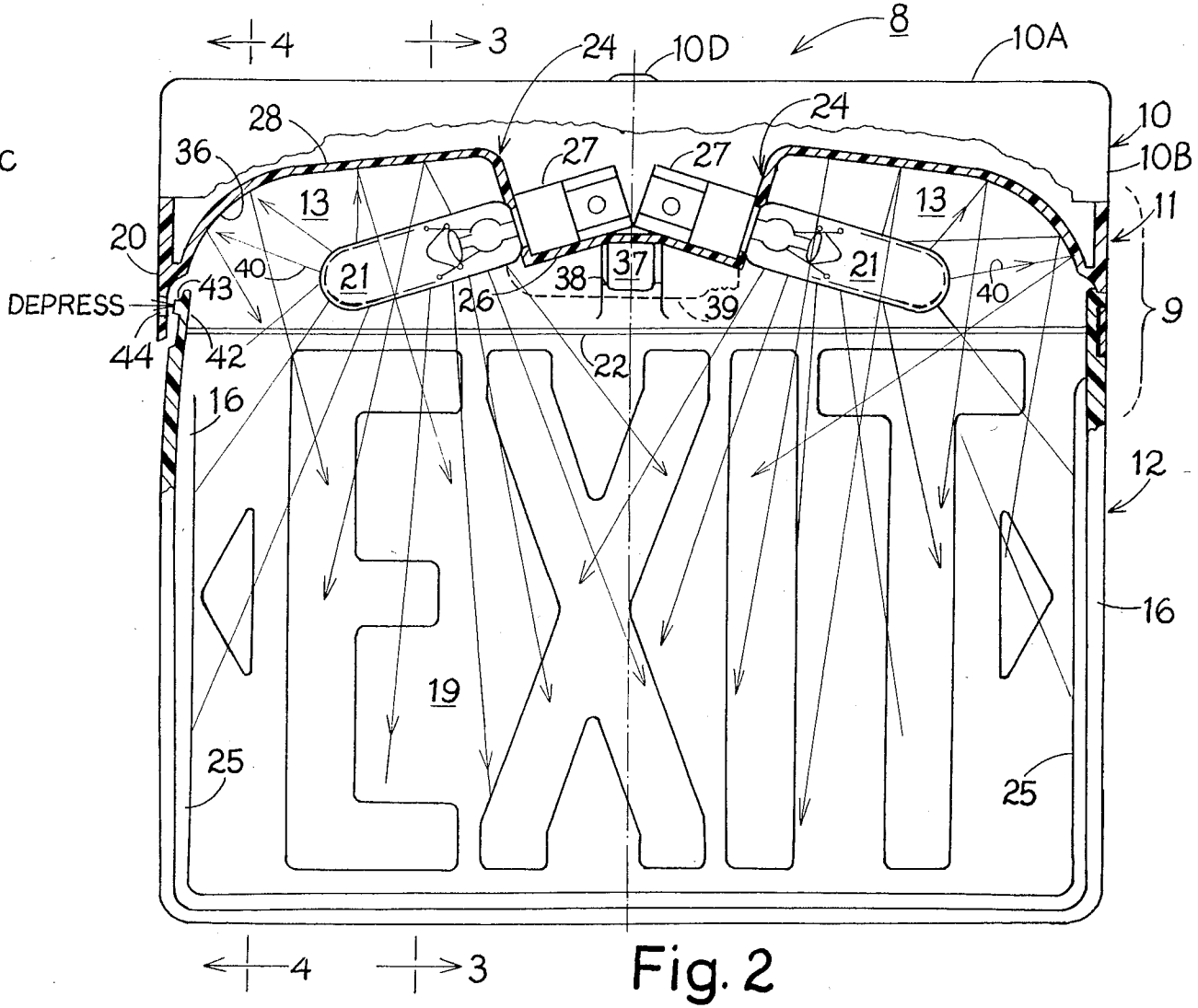
FIG. 2 is a front elevation view, partially broken away in section, of the exit sign shown in FIG. 1.

Opaque "EXIT" sign plaque 19 shown in the drawing is formed as a rectangular panel with sides corresponding to the rectangular opening formed by sidewalls 16, bottom wall 17 and lower edge 18 of front wall 14, and spans the housing internally between guide ridges 25 protruding inward from the facing inner surfaces of the two sidewalls 16, as clearly shown in FIGS. 1 and 2, being thereby exposed and presented to public view through the open lower front aperture portion of housing 9.

Sign plaque 19 is preferably marked with suitable indicia on both its front and reverse faces, and housing 12 is preferably symmetrical about its vertical central plane, assuring that the sign unit 8 is usefully viewed by the public from either direction, and thus utilizing both sides of sign plaque 19 to maximum advantage. If desired, two opaque one-sided sign plaques 19 may be displayed back-to-back.

Within the bulb enclosure 13 forming the upper portion of housing 11 in the preferred embodiment of the invention are a pair of incandescent lamp bulbs 21, positioned centrally above the upper edge of sign plaque 19. If desired, an optional diffuser lens panel 22 extends laterally across the width and depth of the housing 12, between the lower edge 18 of front walls 14 and the sidewalls 20 of bulb enclosure housing 11 directly above sign plaque 19, to diffuse the light descending from bulbs 21 equally and uniformly across the exposed faces of sign plaque 19.

Figure 5:
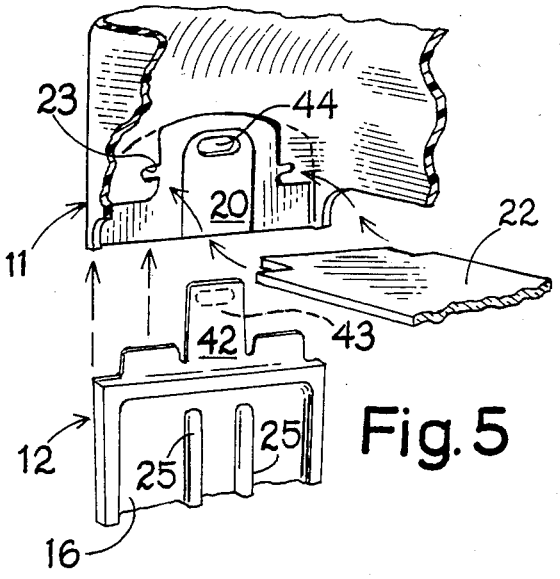
FIG. 5 is a fragmentary, enlarged exploded perspective view of the upper left portion of the exit sign shown in FIG. 2, illustrating the diffuser lens panel and two housing components, showing their interfitting mode of engagement.
Figure 4:
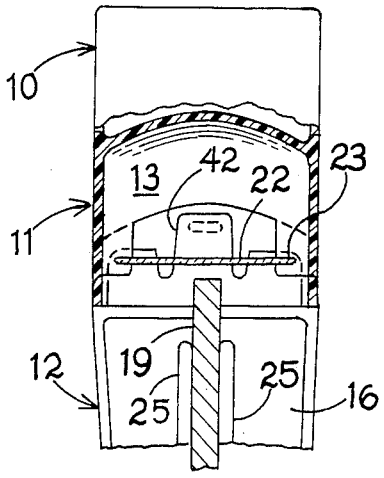
FIG. 4 is a fragmentary cross-sectional end elevation view of the same exit sign taken along the line 4—4 in FIG. 2.
Figure 3:
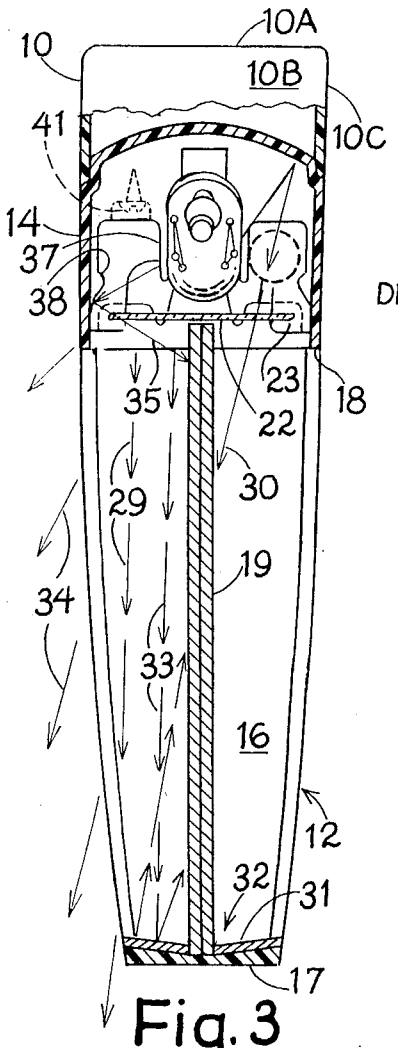
FIG. 3 is a cross-sectional end elevation view of the exit sign of FIGS. 1 and 2 taken along the line 3—3 shown in FIG. 2.

Diffuser lens panel 22 may be formed of lightly frosted sheet plastic or glass, or if desired, it may be formed of molded plastic sheet material having fresnel lens ridge formations in its upper surface, such as those described in U.S. Pat. No. 3,409,347. As indicated in FIGS. 3, 4, and 5, the edge of diffuser lens panel 22 may be embraced within notches 23, formed in the adjacent interior surface of each side wall 20, and thus providing captive support for both ends of lens panel 22, which may be flexed for insertion engagement with notches 23. If lens panel 22 tends to sag, its entire central span will be supported by the upper edge of sign plaque 19, as indicated in FIGS. 3 and 4, thus assuring that lens panel 22 is secured in its desired and intended position between bulbs 21 and sign plaque 19.

A reflector partition 24 overlying bulbs 21 extends across the width of the bulb enclosure portion 13 of housing 11, and a suitable depressed socket mounting zone 26 formed in its central portion is apertured to accommodate and mount bulb sockets 27 positioned to receive lamp bulbs 21 extending from the mounting zone 26 in opposite directions towards the opposite ends of bulb enclosure 13. Concave overlying reflector zones 28 form the remaining portions of the reflector partition 24, and their interior surfaces are arched in configurations designed to trap and reflect downwardly light rays originally delivered upwards from the filaments of bulbs 21 toward the reflector zones, rays marked by the arrows 29 and 30 in FIG. 3. In that figure it will be noted that a portion of the reflected light rays 30, originally delivered upward by bulb 21 are reflected inwardly toward the exposed face of sign plaque 19, illuminating its upper portion.

Another part of the reflected light rays 29 from reflector zones 28 travel downward to impinge upon an underlying flat lower reflector 32. This may be formed as a flat slanting floor of bottom wall 17, and if frame 12 is molded of white or light-colored plastic or metal, this can provide satisfactory reflectivity. If desired, lower reflector 32 may be formed as an inwardly slanting substantially specular mirror surface, which may be formed for example of metalized aluminum foil 31, adhesively bonded to the interior flat surface of bottom wall 17 in the manner illustrated in FIG. 3, from which the light rays 29 are reflected upward and inward toward the lower portion of the exposed face of sign plaque 19. The sign plaque is thus illuminated by direct and reflected illumination along its upper edge and also by reflected illumination from lower reflector 32 along its lower portion, supplementing the reduced intensity of direct illumination and thus providing widely diffused and substantially uniform illumination of the entire exposed surface of sign plaque 19.

It will also be noted that light rays 33, travelling directly downward from bulbs 21 toward lower reflector 32, are also reflected upward and inward by lower reflector 32 toward the lower portion of sign plaque 19.

A still further portion of the illumination from bulbs 21 is represented by the diverging arrows 34, shown at the lefthand side of FIG. 3, and escaping outward from housing 12 between lower edge 18 of front wall 14 and the outer edge of lower wall 17 and between sidewalls 16 through the viewing aperture in which sign plaque 19 is exposed. These diverging light rays 34 are employed to illuminate the region surrounding the sign unit 11 so that its floor and nearby walls are thereby lighted for the convenience of the public. Additional light rays 35 emitted in directions nearly horizontal from bulbs 21 striking the inner faces of front walls 14 are reflected inwardly toward the upper portion of sign plaque 19, as shown in the upper part of FIG. 3. The diffused scattering of these various groups of light rays over the entire face of sign plaque 19 is illustrated schematically in FIGS. 2 and 3. The interior reflector surfaces of reflector partition 24 and front walls 14 as well as bottom reflector 32 may all be formed with highly reflective polished surfaces, which may all be coated with metalized aluminum foil, for example, or may be supplied with other special reflective film, paint or finish.

From FIG. 2 it will be noted that the end portions of the reflector zones 28 closest to sidewalls 16 and 20 are formed in a compoundly curved or spheroidal sector 36 blending smoothly at its lower edge with the sidewalls 20. Light rays 40 delivered in an endwise direction from bulbs 21 toward the sidewalls impinging upon this spheroidal sector 36 of the upper reflector partition 24 are reflected both downward and away from the side wall 16 toward the center of the sign unit 11, as clearly shown in FIG. 2, thus enhancing the illumination of the upper portion of sign plaque 19.

It will be understood that the wall mounting or ceiling mounting fastenings and the electrical wiring have been omitted from the drawings for clarity, and the illuminated signs of the present invention are mounted flush against or depending from the ceiling or projecting from the wall in a conventional manner.

In the preferred embodiment of the invention illustrated in the drawings, the incandescent or fluorescent bulbs 21 are arrayed under a substantially semi-cylindrical reflector section 28 of the reflector partition 24 while the ends of bulbs 21 are embraced or cupped within the compoundly curved concave spheroidal sector 36 of the partition 24. Thus the portions of the sign plaque immediately below bulbs 21 are directly illuminated by the bulbs and also illuminated by reflection from the cylindrical reflector regions 28 of the reflector partition, while all portions of the sign plaque receive reflected illumination delivered by bulbs 21 to each spheroidal sector 36 of the reflector partition 24.

Downward travelling rays of light grazing the sign plaque are reflected up and inward toward the lower portions of the sign plaque by the flat, smooth intilted lower reflector 32. Except for the optional diffuser lens 22, the light illuminating the sign plaque is not absorbed by any translucent material, and it falls either on sign plaque 19 as direct or reflected illumination or is emitted through the aperture of housing 12 to illuminate the surround. Thus, almost all of the light emitted by the incandescent bulbs 21 is usefully employed in the sign units of the present invention, minimizing the power consumption required for their operation.

Directly behind front walls 14 of bulb enclosure housing 11 are spare bulb storage clips, preferably formed by a ledge 38 protruding inwardly from the inner surface of front wall 14, and a resilient clip 37 depending from socket mounting zone 26 of partition 24 (FIGS. 2,3). Clip 37 readily flexes to receive or release a spare bulb 39 which it resiliently urges onto ledge 38 for storage.

The three component parts 10, 11 and 12 of housing 9 are preferably molded of engineering flame retardant thermoplastic material. Bulb enclosure housing 11 is provided with one or more captive screws 41 releasably securing housing 11 to wiring enclosure housing 10. Resilient inwardly depressible upstanding end clips 42 surmounting sidewalls 16 of frame 12 are each provided with an outwardly projecting stud 43 latchable in a latch aperture 44 formed in sidewall 20 of bulb enclosure housing 11 when frame 12 is juxtaposed in abutting engagement beneath housing 11, as shown in FIGS. 1, 3 and 4. Inward flexing of clip 42 disengages stud 43 from aperture 44, as shown in FIGS. 2 and 5, releasing frame 12 for disassembly.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An illuminated sign comprising

A. a single central upstanding flat sign plaque with display indicia on at least one exposed display face, B. a sign plaque-supporting housing assembly having (1) a bottom wall underlying and supporting the sign plaque, (2) upstanding sidewall means adjacent to the sign plaque joined to the bottom wall, forming a U-shaped plaque-embracing sub-frame, (3) a bulb enclosure overlying both faces of the sign plaque to which the sidewall means of the sub-frame are resiliently detachably latched, said sub-frame and bulb enclosure having outer exposed faces positioned in flush relationship forming a plaque-framing housing assembly, (4) lamp bulb means above the sign plaque embraced within the bulb enclosure, positioned to directly illuminate the indicia on the exposed display face of the sign plaque, (5) synclastic compoundly concavely curved reflector means overlying the lamp bulb means, (6) a substantially flat lower reflector underlying the sign plaque, and (7) both said reflector means supplementing the direct illumination with reflected illumination directed toward the exposed display face of the sign, and C. with the sidewall means defining, with the bottom wall and the overlying bulb enclosure, display aperture means through which the sign plaque framed within the housing assembly is presented for view and through which direct and reflected illumination is also delivered downward from the lamp bulb means to the surrounding and underlying area beneath the illuminated sign.

2. The illuminated sign defined in claim 1, wherein the sign plaque has display indicia on both its front and reverse faces, and wherein the housing assembly incorporates two display apertures through which the plaque faces are respectively presented to view.

3. The illuminated sign defined in claim 1, wherein the bulb enclosure portion of the housing assembly includes front wall portions above the aperture means substantially blocking direct level view of the lamp bulb means.

4. The illuminated sign defined in claim 3, wherein the lamp bulb means comprises two elongated lamp bulbs arrayed lengthwise along the upper edge of the sign plaque.

5. The illuminated sign defined in claim 1, wherein the concavely curved reflector means includes an elongated cylindrically curved portion with its axis substantially parallel to the plane of the flat sign plaque.

6. The illuminated sign defined in claim 1, wherein the concavely curved reflector means includes a compoundly curved spheroidal sector near each sidewall edge of the sign plaque, positioned to reflect light rays from the lamp bulb means toward the central portion of the sign plaque.

7. The illuminated sign defined in claim 1 wherein the substantially flat lower reflector is tilted toward the sign plaque receiving descending light rays grazing the sign plaque and reflecting these rays upwardly and inwardly to illuminate the lower portion of the display face of the sign plaque.

8. The illuminated sign defined in claim 1 wherein the housing includes spare bulb storage means including a ledge and a juxtaposed resilient clip, positioned to embrace a spare bulb, resiliently supporting a spare bulb for convenient bulb replacement.

9. The illuminated sign defined in claim 1 wherein the upstanding sidewall means joined to the bottom wall comprise a U-shaped disengagable sub-frame whose uppermost ends are releasably latched to the bulb enclosure by resiliently depressible terminal stud-clips for convenient disengagement of the sub-frame, the central sign plaque and the lower reflector from the bulb enclosure.

10. The illuminated sign defined in claim 1 further including a translucent diffuser lens spanning the bulb enclosure between the lamp bulb means and the sign plaque.

* * * * *